US009719240B1

(12) United States Patent
Montague

(10) Patent No.: US 9,719,240 B1
(45) Date of Patent: Aug. 1, 2017

(54) SOIL EROSION PROTECTION DEVICE FOR USE WITH CATCH BASINS

(71) Applicant: Bryant Montague, Raleigh, NC (US)

(72) Inventor: Bryant Montague, Raleigh, NC (US)

( * ) Notice: Subject to any disclaimer, the term of this patent is extended or adjusted under 35 U.S.C. 154(b) by 860 days.

(21) Appl. No.: 13/658,947

(22) Filed: Oct. 24, 2012

(51) Int. Cl.
*E03F 5/04* (2006.01)

(52) U.S. Cl.
CPC ..... *E03F 5/0404* (2013.01); *E03F 5/0401* (2013.01); *E03F 5/041* (2013.01)

(58) Field of Classification Search
CPC ..... E03F 1/00; E03F 5/0401; E03F 5/0404; E03F 5/041; E03F 5/0411; E03F 5/06; E03F 5/105
USPC ..... 210/747.3, 163, 170.03, 460, 461, 463, 210/474; 404/2, 4, 5; 405/41, 42
See application file for complete search history.

(56) References Cited

U.S. PATENT DOCUMENTS

| | | | | |
|---|---|---|---|---|
| 5,480,254 | A * | 1/1996 | Autry et al. | 404/2 |
| 5,733,444 | A * | 3/1998 | Johnson | 210/163 |
| 6,059,964 | A * | 5/2000 | Strawser, Sr. | 210/164 |
| 6,428,693 | B2 * | 8/2002 | Singleton | 210/163 |
| 6,749,366 | B1 * | 6/2004 | Chinn et al. | 405/41 |
| 7,300,573 | B1 * | 11/2007 | Trangsrud | 210/163 |
| 7,854,838 | B2 * | 12/2010 | Martin | 210/163 |
| 8,557,109 | B1 * | 10/2013 | Sutherland | 210/163 |
| 2009/0101553 | A1 * | 4/2009 | Lucas | 404/4 |

* cited by examiner

*Primary Examiner* — Christopher Upton
(74) *Attorney, Agent, or Firm* — Coats & Bennett, PLLC

(57) ABSTRACT

A portable erosion protection device for use in conjunction with a catch basin is provided. The protection device includes an open base and a perforated wall structure extending upwardly and inwardly to form a pyramid-shaped structure. The base is designed to be mounted on or seated on an upper portion of the catch basin.

2 Claims, 9 Drawing Sheets

SOIL EROSION PROTECTION DEVICE FOR USE WITH CATCH BASINS

FIELD OF THE INVENTION

The present invention relates to soil erosion protection systems and devices, and more particularly to a portable device that is temporarily placed, during a construction period, over a catch basin or other similar structures to prevent silt, debris and other unwanted materials from entering the catch basin.

BACKGROUND OF THE INVENTION

During construction periods, storm drain catch basins and the like must be protected. That is, various local and state regulations require developers to prevent silt, debris and other objects from entering the catch basins during construction of roads and streets. Typically, grading contractors and others that build infrastructure for subdivisions and other developments will erect a structure around the storm drain catch basin to catch silt, debris and other unwanted materials. In one example, the structure utilized comprises a series of vertical posts that are erected around the catch basin. After the posts are erected, a silt fence is wrapped around and secured to the post such that the silt fence extends around the inlet to the catch basin.

There are a number of problems with this approach. First, building temporary silt protection devices around each catch basin is very laborious, time consuming and expensive. A normal subdivision will have many catch basins and, in the end, erecting these temporary silt fences is extremely costly. The second problem is that conventional silt fences around storm drain catch basins are not entirely effective. They often fail. This occurs sometimes when there is a large storm and large amounts of storm water rush toward the silt fence extending around the catch basin. It is not unusual for the storm water to carry so much silt and debris that the fence and the structure supporting the fence collapse, resulting in substantial volumes of silt, debris and other unwanted objects entering the catch basin.

SUMMARY OF THE INVENTION

The present invention relates to a temporary and portable erosion protection device for a catch basin. The protection device of the present invention includes a base and a perforated wall structure extending upwardly from the base. The base is designed to be mounted on or seated on the upper portion of a catch basin.

In one embodiment, the erosion protection device of the present invention comprises a base and a series of upstanding perforated wall sections that are secured together to form a pyramid shape. Again, the base is designed to seat onto a catch basin. In this embodiment, the base includes an outwardly projecting ledge that projects outwardly from the perforated wall sections. Filtering stone, such as wash stone, is supported on the ledge and is typically piled around the perforated wall sections for the erosion protection device.

DESCRIPTION OF THE INVENTION

Figure 1:
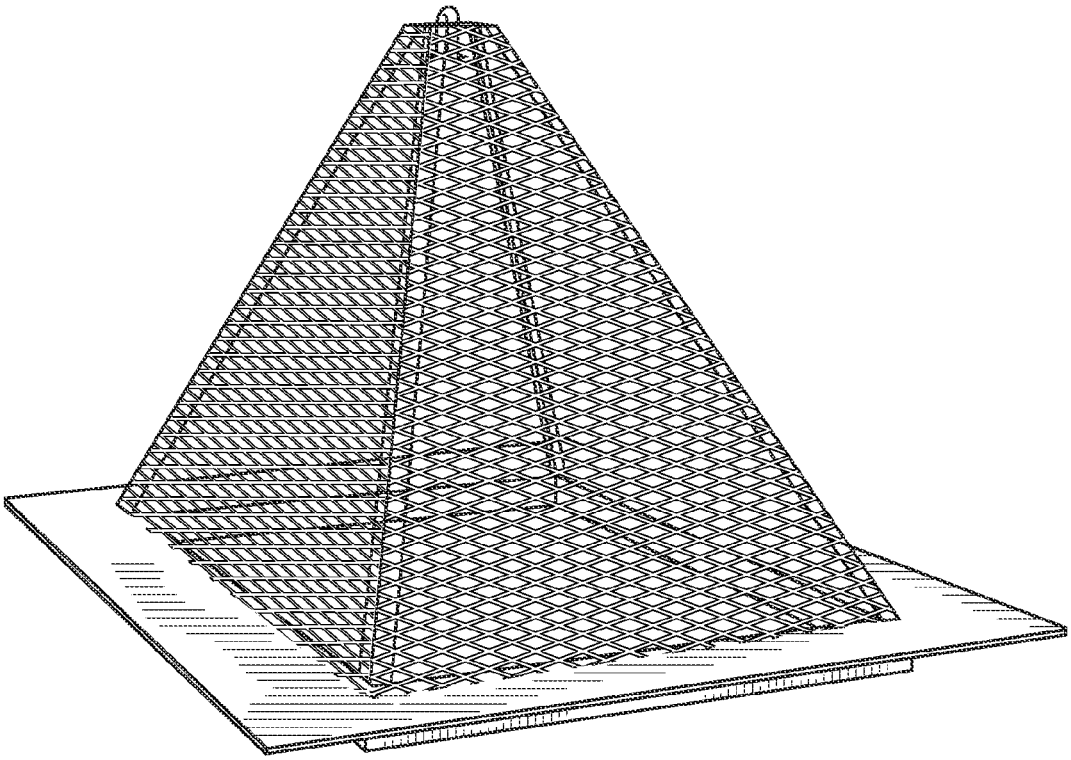
FIG. 1 is a perspective view of the erosion protection device of the present invention.

With further reference to the drawings, particularly FIG. 1, the protection device is shown therein and indicated generally by the numeral 10. At various times the protection device 10 is referred to as an erosion protection device, catch basin protection device and a portable protection structure. As will be discussed herein, the protection device 10 is designed to interface with a storm drain catch basin or other types of catch basins that receive water. With reference to the drawings, the catch basin 12 is shown in FIGS. 3-6. It is understood that the protection device 10 of the present invention is effective with many different types of catch basins and water inlets.

Turning to a more detailed discussion of the protection device 10, the protection device 10 includes an open base indicated generally by the numeral 14. As seen in FIG. 1, the base extends completely around the protection device and is open about the interior thereof such that water entering the protection device 10 can flow downwardly through the open area into the underlying catch basin 12. In the embodiment shown in the drawings, the base 14 includes a horizontal ledge 16 that projects outwardly from the protection device. Note that the horizontal ledge 16 includes a substantial surface area and projects substantially outwardly from the device. As will be appreciated from subsequent portions of this disclosure, the horizontal ledge 16 functions to support filtering stone 40 such as wash stone or other filtering particles or media. Also forming a part of the base 14 is a stop or flange 18. Note that the stop or flange 18 is secured to the inner edge of the horizontal ledge 16 and projects slightly downwardly therefrom. As will be explained below, the stop or flange 18 functions to maintain the protection device 10 in a stable condition on the catch basin 12. More particularly, the stop or flange 18 projects downwardly and is dimensioned with respect to an inlet of the catch basin such that the stop or flange prevents the protection device from moving substantially laterally once the protection device is placed over the catch basin. This will prevent the protection device from being accidentally moved or misaligned with the catch basin 12.

Extending upwardly and inwardly from the base 14 is a series of perforated wall sections. Each wall section is referred to by the numeral 20. In one embodiment, each wall section includes an expanded metal panel. As seen in the drawings, each wall section is generally triangularly shaped and tapers inwardly from its base to its upper end. That is, as viewed in FIGS. 1 and 3, the base of each wall section has a length substantially greater than the length of the opposing upper edge.

Wall sections 20 are secured together to form a generally pyramid shape. See FIG. 1. There is provided a top 22 that is secured to the upper portion of each of the wall sections 20.

A series of vertical reinforcing members 24 are employed to reinforce the protection device 10. As seen in the drawings, each vertical reinforcing member 24 is connected to outer side edges of two wall sections 20. Further, the reinforcing members 24 along with the base of each wall section is secured by weldment or other suitable means to the base 14.

Figure 6:
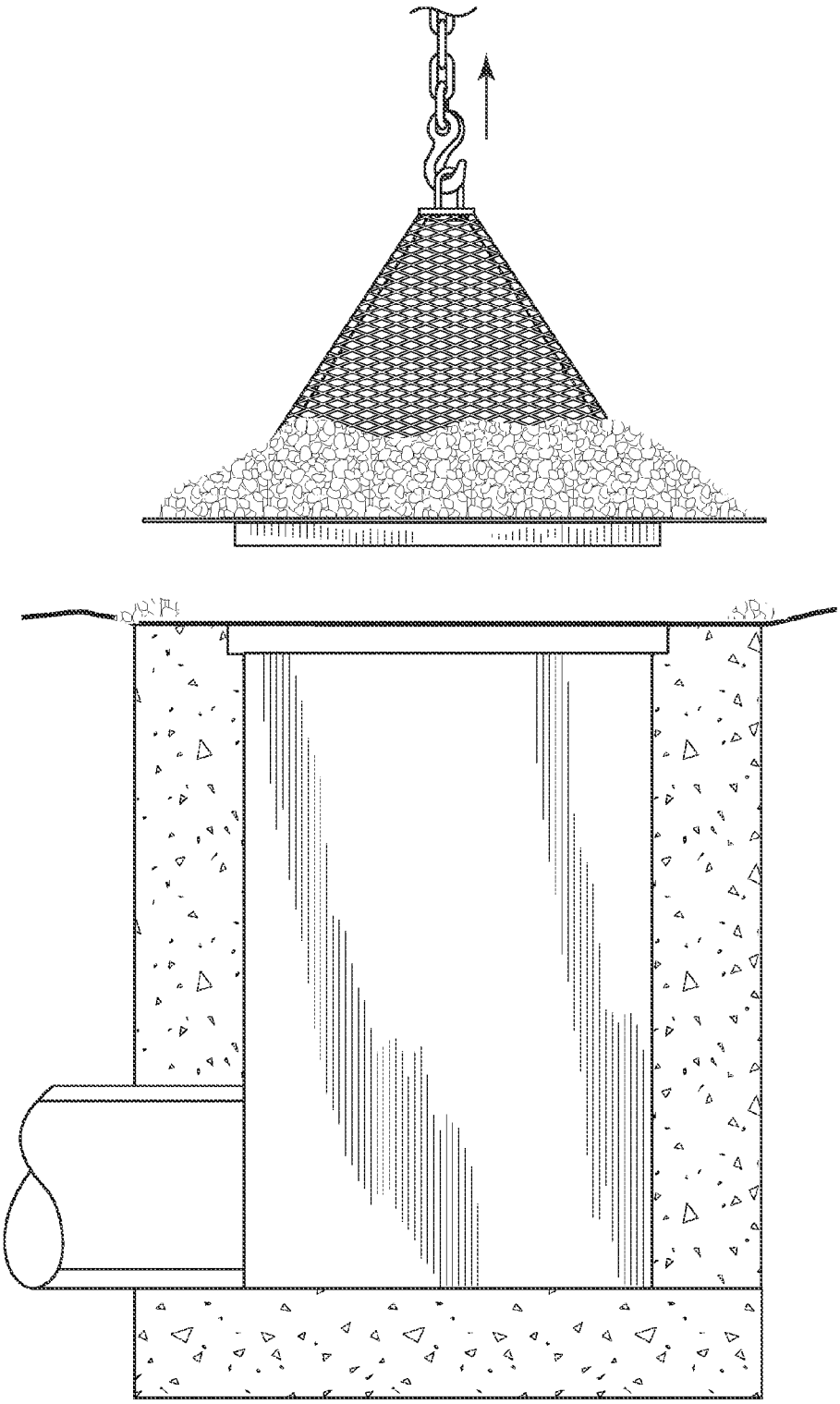
FIG. 6 is a view similar to FIG. 3 but showing the protection device being removed from a catch basin.
Figure 9A:
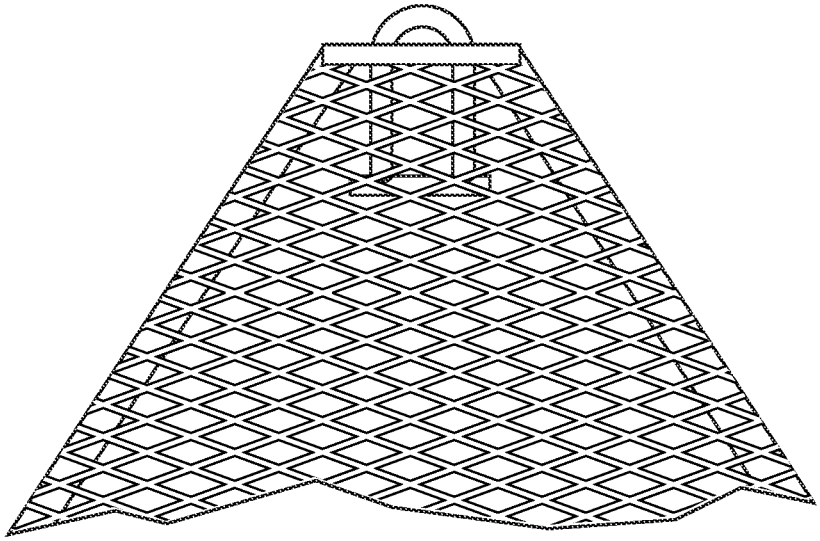
FIG. 9A is a fragmentary side elevational view of the protection device showing the handle thereof in a retracted position.
Figure 9B:
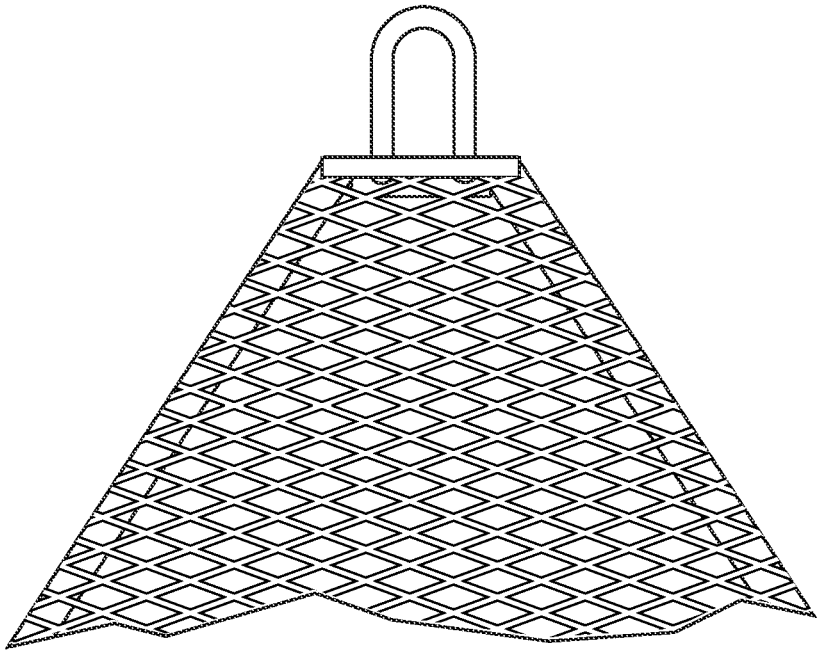
FIG. 9B is similar to FIG. 9A but showing the handle extended.

Protection device 10 is portable and designed to be temporarily used to provide erosion control for a catch basin. Thus, the protection device is designed to be moved from one catch basin to another catch basin or moved to a storage area for storage until it is used again at another catch basin. In order to facilitate the movement of the protection device, there is provided a retractable handle 26 that is moveably supported in the top 22. As seen in FIG. 9A, when not in use, the handle 26 simply falls to the retracted position. When used, the handle 26 is extended upwardly from the top 22 and can be connected to a connector such as shown in FIG. 6 which enables the protection device and filtering stone 40 supported thereon to be lifted upwardly by a powered implement such as a front end loader, backhoe, or other similar equipment typically found on a construction site.

Figure 7:
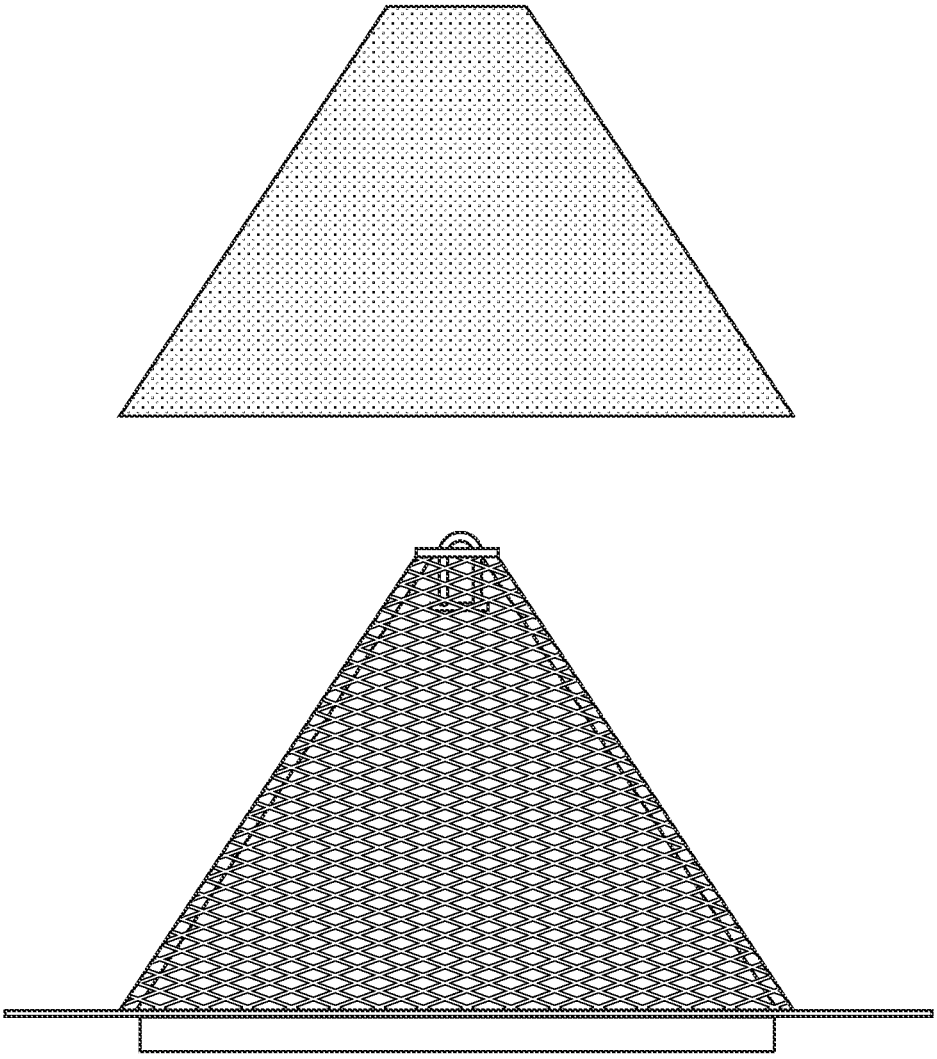
FIG. 7 is a view illustrating a filter configured to fit over the protection device.

Various accessories can be provided with the erosion protection device 10. For example, in FIG. 7, there is shown a filter bag 28 that is designed to have generally the same shape as the wall sections 20 of the protection device. Filter bag 28 includes a surrounding side structure that is designed to provide relatively fine filtration compared to the perforated openings of the wall sections 20. Filter bag 28 thus assumes a generally pyramid shape and is open from the bottom, as viewed in FIG. 7, such that it can simply be slipped down over the exterior surfaces of the wall sections 20.

Turning to FIGS. 3-6, there is shown therein a catch basin indicated generally by the numeral 12. It is appreciated that the protection device 10 of the present invention is designed to be used with a wide range of water inlets and that the size and shape of various inlets of catch basins may vary and that the protection device of the present invention can be dimensioned and/or configured to appropriately fit these inlets. The term "catch basin" as used herein is a broad term to define structures that function to receive surface water runoff. As seen in the drawings, the catch basin 12 shown herein includes a bottom 30 and a surrounding wall structure 32. An outlet pipe 34 is communicatively connected to the catch basin 12. Further, the catch basin 12 includes an upper inlet 36. This is an opening formed in the top of the catch basin 12 which will eventually receive a permanent screening device. The present invention, however, is directed to a temporary and portable structure that is utilized on the catch basin 12 to control erosion during a construction period. Thus, the protection device 10 of the present invention is only used temporarily on the catch basin.

Figure 3:
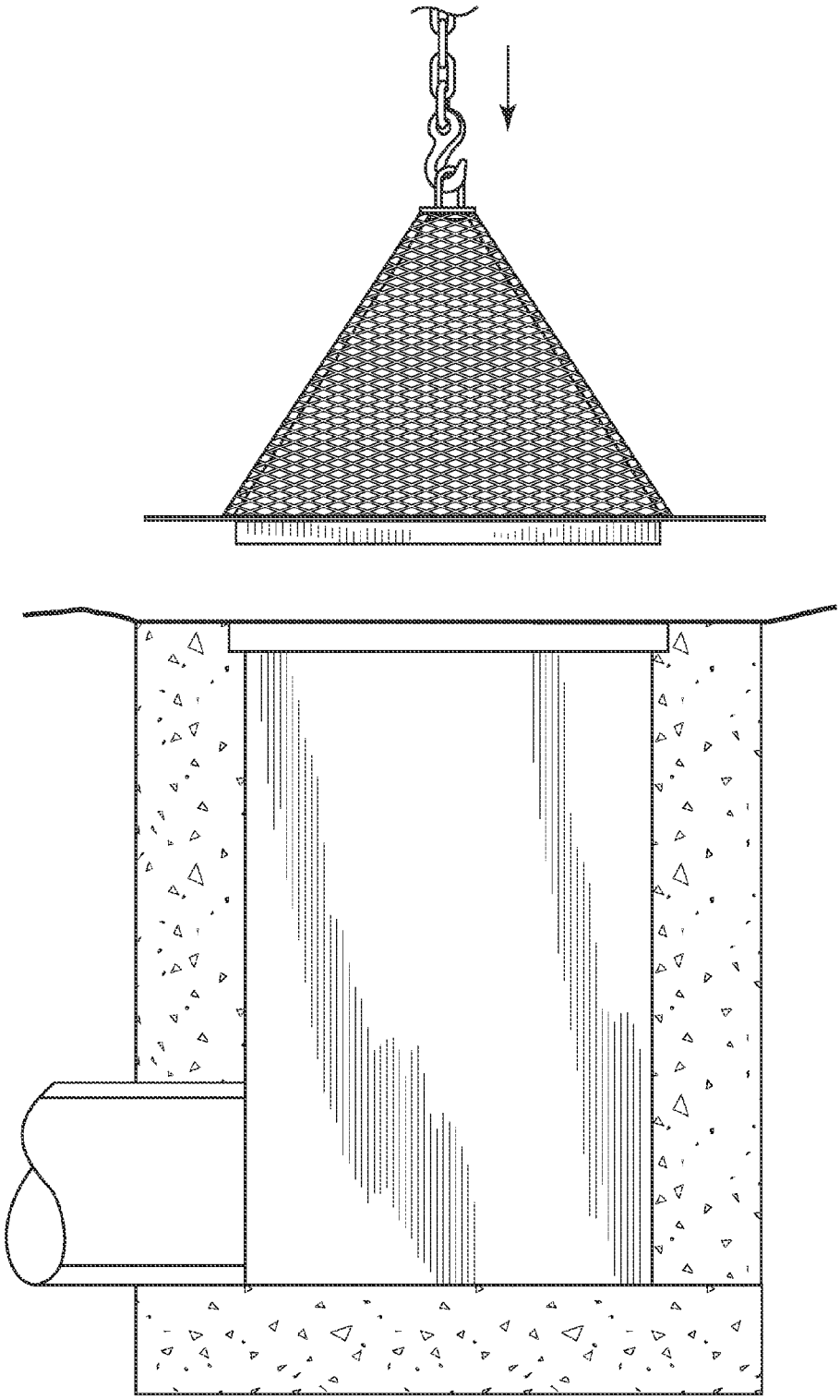
FIG. 3 is a side elevational view showing the catch basin in section and showing the protection device of the present invention being lowered onto the catch basin.

As seen in FIG. 3, the portable protection device 10 is placed into operation by lowering the same onto the catch basin 12. A typical catch basin has an inlet opening of approximately 2'×3'. This can, of course, vary. The base 14 of the protection device 10 is dimensioned to fit the inlet 36 of the catch basin.

Figure 4:
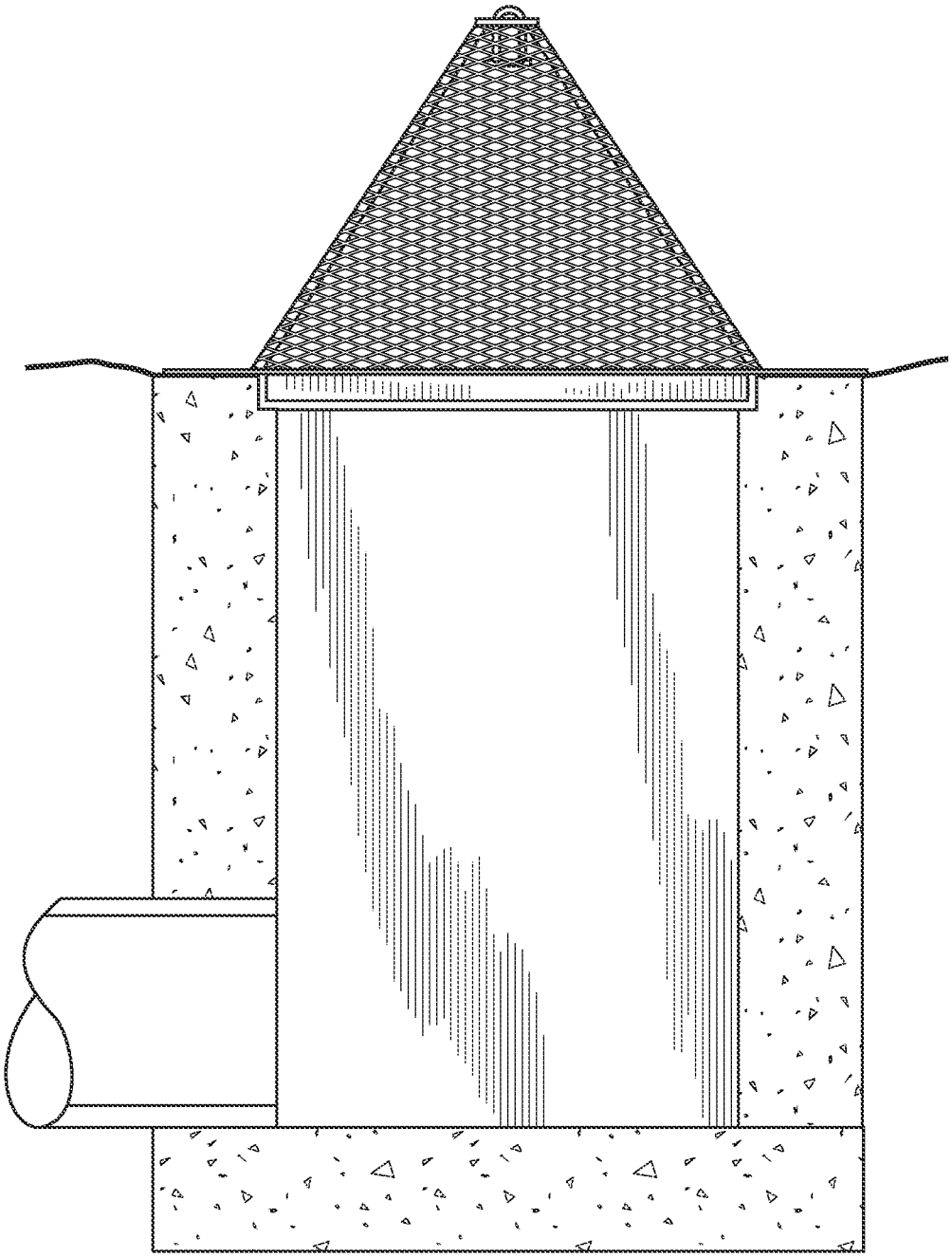
FIG. 4 is a view similar to FIG. 3 but showing the protection device supported on the catch basin.
Figure 5:
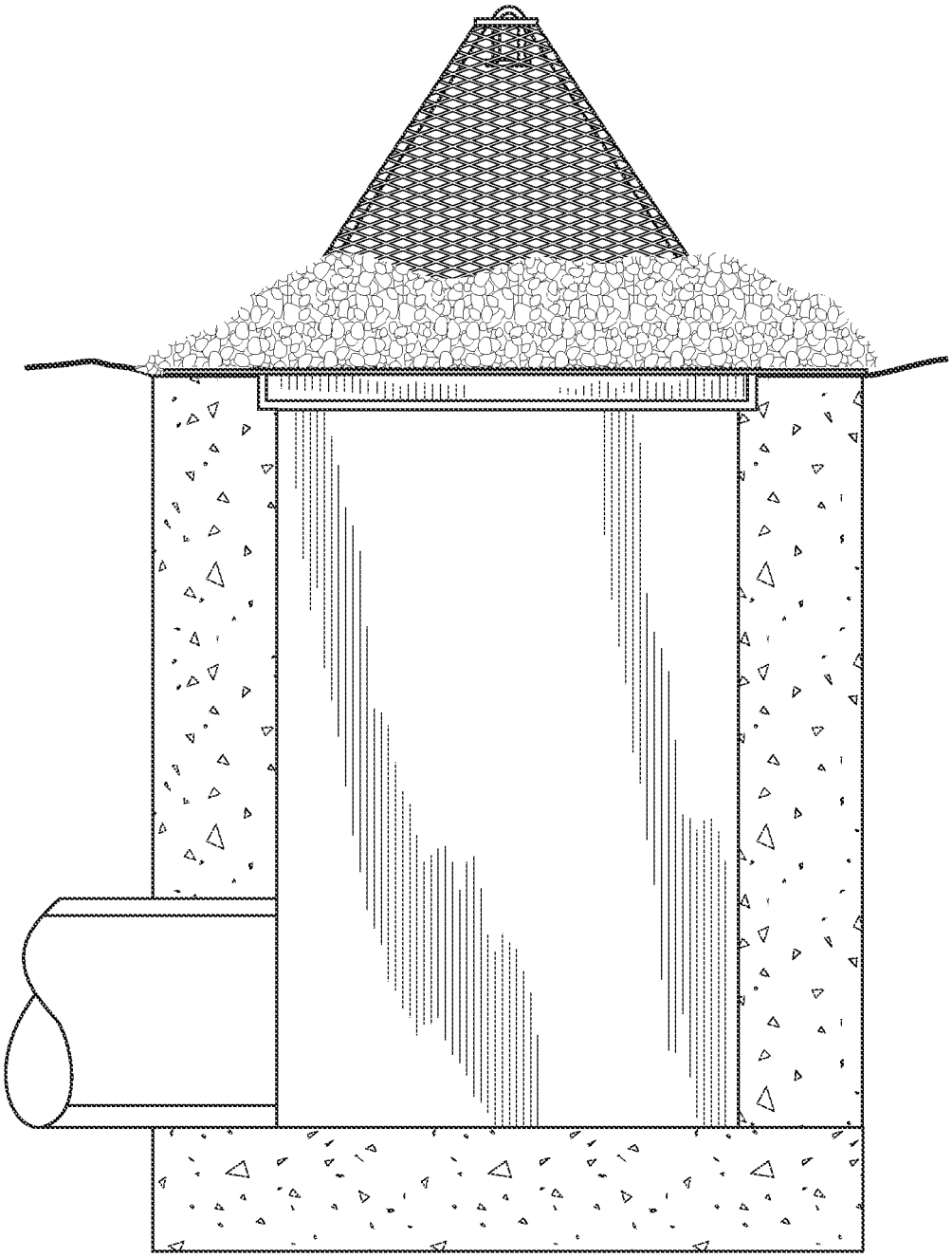
FIG. 5 is a view similar to FIG. 4 but showing filtering stones, such as wash stone, supported on the protection device.
Figure 8:
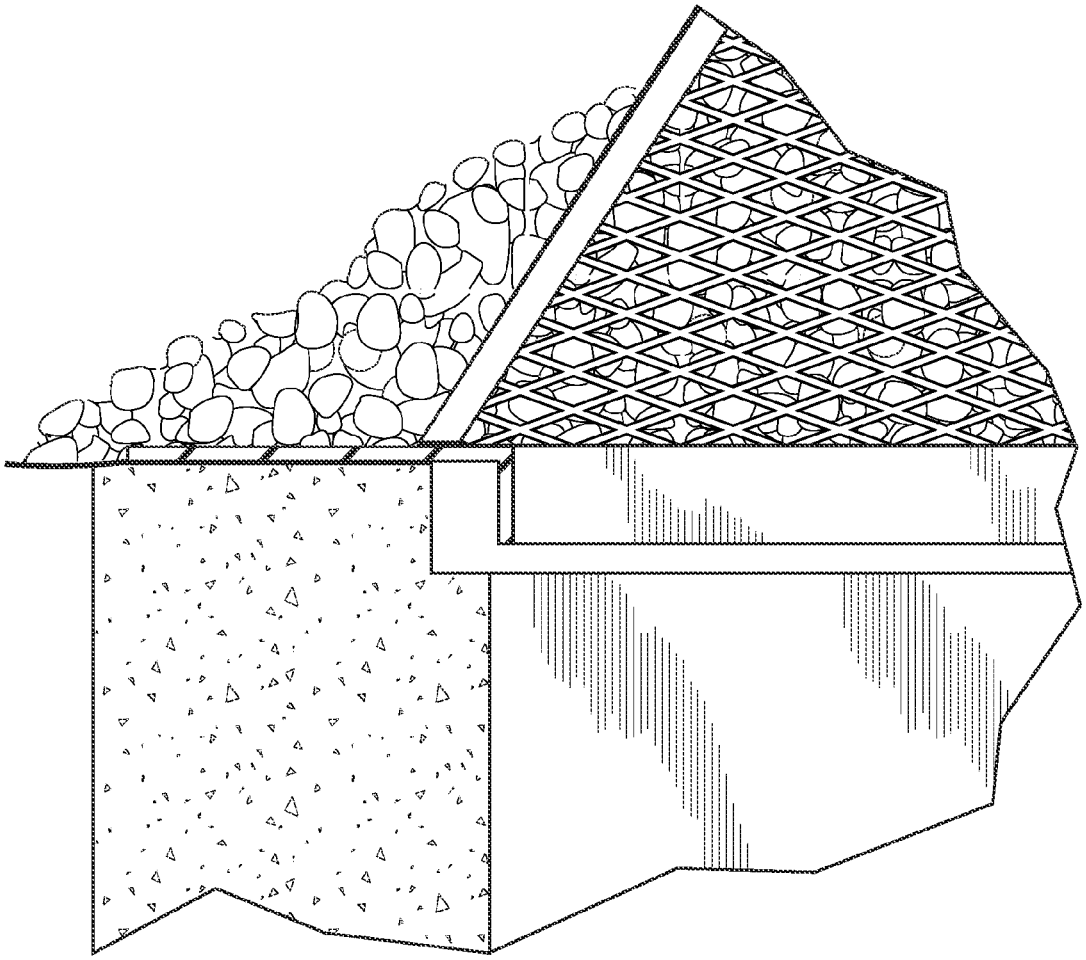
FIG. 8 is a fragmentary sectional view showing how the base of the protection device interfaces with the catch basin.

Once the protection device 10 is lowered onto the catch basin 12 as shown in FIG. 4, it is seen that the ledge 16 extends over a substantial portion of the walls of the catch basin. In alternate embodiments, the ledge 16 could even extend further and even extend substantially past the outer edges of the walls of the catch basin. Note that the stop or flange 16 projects downwardly into the inlet 36. In the embodiment illustrated herein, the stop or flange 18 extends completely around the inlet 36 of the catch basin 12. Flange or stop 18 is dimensioned such that it fits fairly close to an inside portion of the catch basin 12. Note in FIG. 8 where the stop or flange 18 is closely spaced to the inside surface of the wall 32. While the protection device may move slightly laterally back and forth, the dimensions of the flange or stop 18 assures that there is no substantial lateral movement of the device 10. This maintains the device 10 on the catch basin even if accidentally hit by machinery or by workers.

Figure 2:
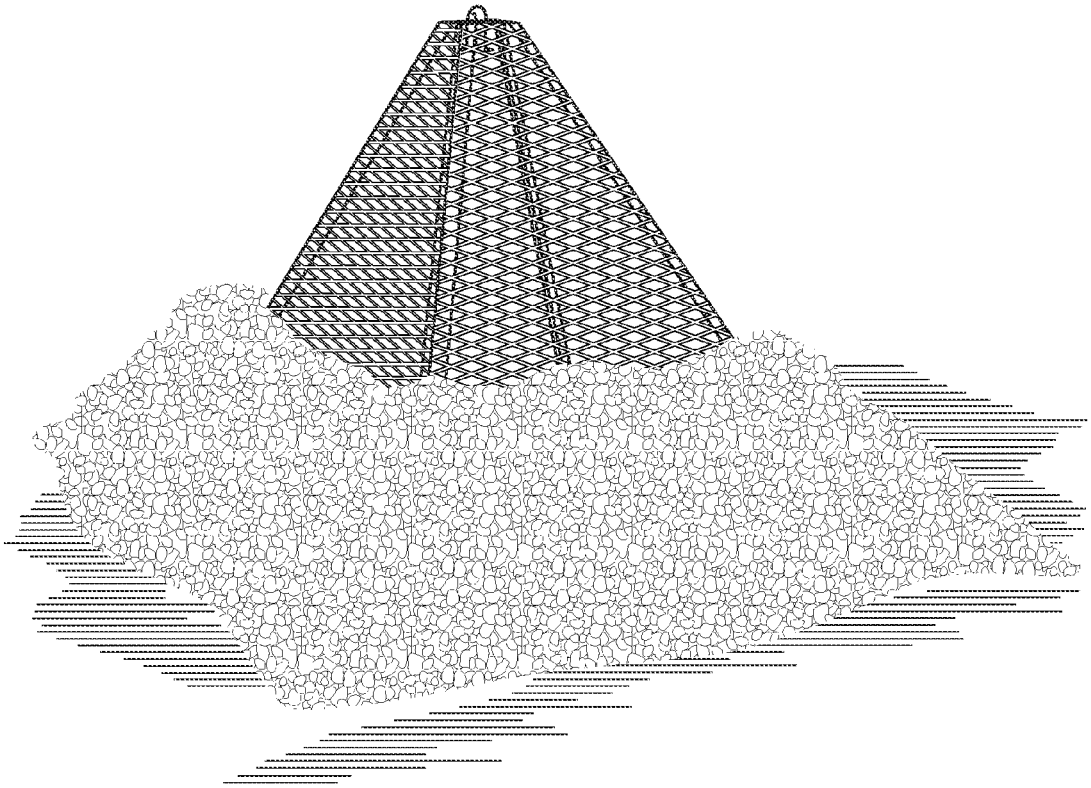
FIG. 2 is a perspective view of the erosion protection device of the present invention shown installed over a catch basin.

Once the protection device is seated on the catch basin 12, then filtering stone 40, such as wash stone, is poured or piled onto the ledge 16. The filtering stone is piled to a selected height. See, for example, FIGS. 2, 5 and 8. Thus, the filtering stone 40 is supported by the base and particularly the ledge 16.

It follows that in use, when there is a substantial storm where there is a significant amount of runoff directed towards the catch basin 12, that the water associated therewith will engage the filtering stone 40 and pass through the filtering stone into and through the perforated wall sections 20. The filtering stone, in combination with the perforated wall sections, will filter silt, debris and other unwanted materials from the water passing. This effectively protects the catch basin 12 and is an effective measure for erosion control.

It is appreciated that once appropriately placed over the catch basin, that the protection device 10 is stable and structurally sound. The general shape of the wall sections 20 make the unit self-supporting and protect against the possibility of the structure collapsing. At the conclusion of the construction project, the portable and temporary protection device 10 is simply removed from the catch basin. This is illustrated in FIG. 6. Again, a mechanical lifting device can be used or the protection device can be lifted by hand. As shown in FIG. 6, as the protection device is lifted from the catch basin 12, a substantial portion of the filtering stone 40 is supported on the ledge 16 and actually carried with the protection device as it is raised. Thereafter, the protection device can be installed on another catch basin on a temporary basis or can be placed in storage until there is a need to use it again in another location.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A method of temporarily protecting storm drain catch basins and preventing silt and other debris from entering the inlet of a catch basin during a construction period, the method comprising:

placing a portable screening device over the inlet of the catch basin where the portable screening device includes perforated wall sections that extend upwardly and inwardly relative to the inlet of the catch basin and a horizontal stone holding ledge that forms an exposed ledge when placed over the outlet of the catch basin and which extends around the portable screening device and forms a part of a portable screening device as the exposed ledge projects substantially outwardly from the lower portion of the perforated wall sections;

piling filter stones on the exposed ledge of the screening device and continuing to pile stones on the exposed ledge, causing the stones to accumulate around lower portions of the wall sections such that the filter stones overlie the exposed ledge of the screening device and cover a lower portion of the perforated wall sections of the portable screening device;

supporting the piled filter stones on the exposed ledge that is supported on the inlet of the catch basin and also supporting at least some of the stones on the lower portion of the perforated wall sections;

filtering silt and debris from water as the water passes through the filtering stones and through the perforated wall sections into the catch basin;

after a selected period of time, removing the portable screening device and the stones together as a unit from the catch basin whereby the portable screening device and stones can be used temporarily on another storm drain catch basin; and wherein moving the portable screening device from the inlet of the catch basin includes lifting the screening device upwardly from the inlet of the catch basin and lifting the stones with the screening device and moving the screening device along with the stones supported on the exposed ledge and lower portion of the perforated wall section to another catch basin and lowering the screening device and the stones supported thereon onto an inlet of the other catch basins; and wherein the method includes directly supporting the stones on the exposed ledge and on the lower portion of the perforated wall sections of the screening device.

2. The method of claim 1 wherein the horizontal stone holding ledge and the wall sections form an angle greater than 90° and a method includes piling stones onto the stone holding ledge and causing portions of the stone to overlie lower portions of the wall sections such that at least a portion of the stone piled on the portable screening device is supported by the lower portion of the wall sections.

* * * * *